US006758870B2

(12) United States Patent
Waller et al.

(10) Patent No.: US 6,758,870 B2
(45) Date of Patent: Jul. 6, 2004

(54) METHOD OF PRODUCING A DIESEL FUEL BLEND HAVING A PRE-DETERMINED FLASH-POINT AND PRE-DETERMINED INCREASE IN CETANE NUMBER

(75) Inventors: Francis Joseph Waller, Allentown, PA (US); Robert Quinn, East Texas, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/050,330

(22) Filed: Jan. 16, 2002

(65) Prior Publication Data

US 2002/0134008 A1 Sep. 26, 2002

Related U.S. Application Data

(63) Continuation of application No. 09/593,871, filed on Jun. 14, 2000, now abandoned.

(51) Int. Cl.[7] ..... C10L 1/18

(52) U.S. Cl. ..... 44/388; 44/443; 44/444; 44/446; 44/447; 44/448; 44/452

(58) Field of Search ..... 44/446, 447, 452, 44/388, 443, 444

(56) References Cited

U.S. PATENT DOCUMENTS

| | | | | | |
|---|---|---|---|---|---|
| 2,350,145 | A | * | 5/1944 | Backoff et al. | 44/402 |
| 3,594,136 | A | * | 7/1971 | Rosen | 44/443 |
| 3,615,292 | A | * | 10/1971 | Badin | 44/363 |
| 3,639,109 | A | * | 2/1972 | Badin | 44/363 |
| 4,207,078 | A | * | 6/1980 | Sweeney et al. | 44/359 |
| 4,265,638 | A | * | 5/1981 | Burke | 44/438 |
| 4,378,973 | A | * | 4/1983 | Sweeney | 44/352 |
| 4,398,920 | A | * | 8/1983 | Guibet et al. | 44/438 |
| 4,424,063 | A | | 1/1984 | Hart | 44/56 |
| 4,818,250 | A | | 4/1989 | Whitworth | 44/62 |
| 5,858,030 | A | | 1/1999 | Waller et al. | 44/448 |
| 5,931,977 | A | * | 8/1999 | Yang | 44/320 |

OTHER PUBLICATIONS

The Merck Index, 10 th Ed., Merck & Co., Inc., #3146 Diglyme, 1983, p. 459.*

Sax et al, Hawley's Condensed Chemical Dictionary, 1987, Van Nostrand Reinhold, N.Y., 11$^{th}$ Ed., Glyme, p. 571.*

G. J. Suppes, et al., Compression—Ignition Fuel Properties of Fischer–Tropsch Syncrude, Ind. Eng. Chem. Res., 1998, vol. 37, pp. 2029–2038.

* cited by examiner

*Primary Examiner*—Cephia D. Toomer
(74) *Attorney, Agent, or Firm*—Keith D. Gourley

(57) ABSTRACT

The present invention relates to a method of producing a diesel fuel blend having a pre-determined flash-point and a pre-determined increase in cetane number over the stock diesel fuel. Upon establishing the desired flash-point and increase in cetane number, an amount of a first oxygenate with a flash-point less than the flash-point of the stock diesel fuel and a cetane number equal to or greater than the cetane number of the stock diesel fuel is added to the stock diesel fuel in an amount sufficient to achieve the pre-determined increase in cetane number. Thereafter, an amount of a second oxygenate with a flash-point equal to or greater than the flash-point of the stock diesel fuel and a cetane number greater than the cetane number of the stock diesel fuel is added to the stock diesel fuel in an amount sufficient to achieve the pre-determined increase in cetane number.

9 Claims, 3 Drawing Sheets

METHOD OF PRODUCING A DIESEL FUEL BLEND HAVING A PRE-DETERMINED FLASH-POINT AND PRE-DETERMINED INCREASE IN CETANE NUMBER

CROSS-REFERENCE TO RELATED APPLICATIONS

This patent application is a continuation of U.S. patent application Ser. No. 09/593,871, filed on Jun. 14, 2000, now abandoned, the specification and claims which are incorporated by reference and made a part of this patent application.

STATMENT REGARDING FEDERALLY SPONSERED RESEARCH OR DEVELOPMENT

This invention was made with Government support under Cooperative Agreement DE-FC22-95PC93052 awarded by the United States Department of Energy. The Government has certain rights in this invention.

BACKGROUND OF THE INVENTION

Diesel fuels constitute a broad class of petroleum products and include distillate or residual materials (or blends of these two) from the refining of crude oil and are typically used in compression ignition or diesel engines. The two primary criteria used to define a diesel fuel are the distillation range (generally between 150° and 380° C.) and specific gravity range (between 0.760 and 0.935 at 15° C.). The properties of diesel fuel greatly overlap those of kerosene, jet fuels, and burner fuel oils and thus all these products are generally referred to as intermediate distillates.

The flash-point is the lowest temperature at which vapors from a petroleum product such as diesel fuel will ignite on application of a small flame under standard test conditions. The approximate boiling range of diesel fuel is 150–380° C. The lower end of this range (vapor pressures of hydrocarbons) tends to correlate with typical flash-point temperatures of greater than 38° C. (greater than 56° C. in some European countries) for diesel fuel. Due to safe handling and storage considerations and a legal flash-point requirement for diesel fuel, it is desirable to control the flash-point of diesel fuel blend.

The cetane number of a diesel fuel is roughly analogous to the octane number of gasoline. A high cetane number indicates the ability of a diesel engine fuel to ignite quickly after being injected into the combustion cylinder.

Particulate matter consists essentially of very small particles of carbonaceous soot and results from the incomplete combustion of fuel droplets. Particulate matter is subject to strict regulatory restrictions.

The cloud point is the temperature at which a sample of a petroleum product just shows a cloud or haze of wax crystals when cooled under standard test conditions. The cloud point of a diesel fuel is important for its low temperature performance. All of the above four characteristics should be taken into account when blending a diesel fuel.

The present legal flash-point requirements are summarized below by geographic region:

| Country | Flash-point (° C.) of diesel fuel |
|---|---|
| Europe | 55 |
| Canada | 40 |
| U.S.A. | 38 |

U.S. Pat. No. 4,424,063 discloses diesel fuel additives which increase the flash-point of the resulting composition from 6 to 29° C. These additives are elemental iron, methyl isobutyl ketone, picric acid, normal butyl alcohol, nitrobenzene and primenes (tertiary alkylamines). Methyl isobutyl ketone and normal butyl alcohol are oxygenated compounds. Normal butyl alcohol has an estimated cetane number between 12–18 based on other linear low molecular weight alcohols.

U.S. Pat. No. 4,818,250 discloses adding hydrogenated limonene (saturated paraffin) or distilled limonene with an anti-oxidant to diesel fuel. Both modifications prevent gum from forming in the diesel fuel blend. However, limonene in a 10/90 blend with diesel fuel lowers the cetane number from 51.5 (no limonene) to 48.0. The flash-point of limonene is 49° C. The flash-point of the diesel fuel is 60° C. In this example, limonene can be used as a partial substitute for diesel fuel, but it lowers the cetane number of the diesel fuel blend.

U.S. Pat. No. 5,858,030 discloses diesel fuel compositions for increasing cetane number by adding oxygenates of dimethoxypropane and dimethoxyethane or dimethoxyethane with methanol and dimethoxymethane to diesel fuel. In this example methanol and dimethoxymethane only have cetane numbers of 5 and 29, respectively.

The above patents fail to teach a method which is capable of simultaneously and independently adjusting flash-point and cetane number of the final diesel fuel and possibly to also decrease particulate matter emissions.

Researchers are looking for a method which can be universally applied to produce a diesel fuel blend from any available stock diesel fuel wherein the diesel fuel blend can be prepared to possess any desired flash point and cetane number in order to meet the fuel properties required in any given locality.

Furthermore, researchers are looking for a method to control the flash-point of a diesel fuel blend utilizing blending components which improve the performance of the diesel fuel blend. An increase in performance can be measured by the increase of cetane number of the blended fuel, a decrease in particulate matter, negligible effect on cloud point and miscibility over a wide temperature range.

BRIEF SUMMARY OF THE INVENTION

The present invention, which overcomes the disadvantages of prior art, relates to a method of producing a diesel fuel blend having a pre-determined flash-point and a pre-determined increase in cetane number, comprising the steps of:

a) selecting a stock diesel fuel with a flash-point and a cetane number, b) establishing the pre-determined flash-point and the pre-determined increase in cetane number of the diesel fuel blend to be produced;

c) adding an amount of a first oxygenate with a flash-point less than the flash-point of said stock diesel fuel and a cetane number equal to or greater than the cetane number of said stock diesel fuel, said amount being sufficient to adjust the flash-point of the diesel fuel blend to the pre-determined flash-point; and d) adding an amount of a second oxygenate with a flash-point equal to or greater than the flash-point of said stock diesel fuel and a cetane number greater than the cetane number of said stock diesel fuel, said amount being sufficient to achieve the pre-determined increase in cetane number wherein the first oxygenate and the second oxygenate are not the same oxygenate.

To adjust the final flash-point the amount of the first oxygenate can according to a first embodiment be determined by the equation $$T_1/T_2=1+T_1 R ln[x]/\Delta H$$

wherein $T_1$ is the flash-point temperature of the first oxygenate, $T_2$ is the pre-determined flash-point temperature of the diesel fuel blend, R is the ideal gas constant, ΔH is the enthalpy of vaporization of the first oxygenate, and

[x] is the mole fraction of the first oxygenate in the diesel fuel blend.

In another embodiment of the present invention, the amount of the first oxygenate to adjust the final flash-point is obtained from a calibration curve established by measuring the final flash-point of various mixtures of the stock diesel fuel and the first oxygenate.

The amount of the second oxygenate to adjust the final cetane number can be obtained from a calibration curve established by measuring the final cetane number of various mixtures of the stock diesel fuel and the second oxygenate.

DETAILED DESCRIPTION OF THE INVENTION

Figure 1:
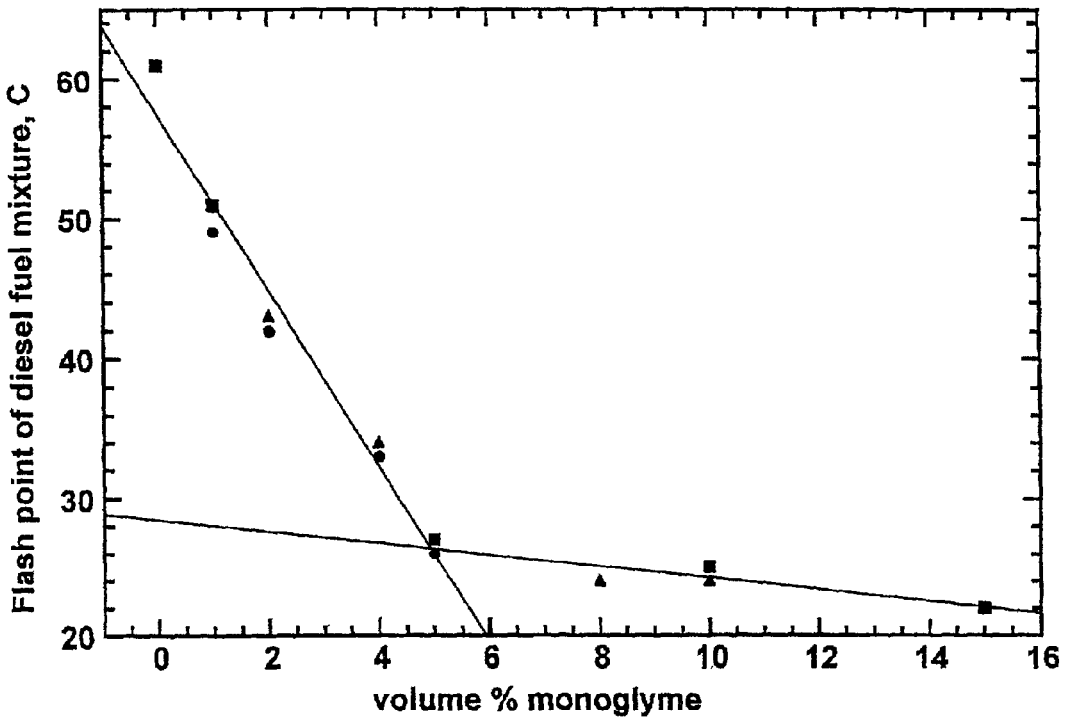
FIG. 1 illustrates the final flash-point of diesel fuel blended with monoglyme or a mixture of monoglyme/diglyme as a function of volume % blended monoglyme.

The present invention relates to a method of producing a diesel fuel blend having a pre-determined flash-point and a pre-determined increase in cetane number, comprising the steps of:

a) selecting a stock diesel fuel with a flash-point and a cetane number, b) establishing the pre-determined flash-point and the pre-determined increase in cetane number of the diesel fuel blend to be produced;

c) adding an amount of a first oxygenate with a flash-point less than the flash-point of said stock diesel fuel and a cetane number equal to or greater than the cetane number of said stock diesel fuel, said amount being sufficient to adjust the flash-point of the diesel fuel blend to the pre-determined flash-point; and d) adding an amount of a second oxygenate with a flash-point equal to or greater than the flash-point of said stock diesel fuel and a cetane number greater than the cetane number of said stock diesel fuel, said amount being sufficient to achieve the pre-determined increase in cetane number wherein the first oxygenate and the second oxygenate are not the same oxygenate.

In describing the steps of the method in greater detail, step a) requires selecting any available stock diesel fuel which is available in the market. The flash-point and cetane number of such stock diesel fuel is then determined by conventional methods.

Thereafter, step b) involves establishing the pre-determined flash-point and the pre-determined increase in cetane number of the diesel fuel blend to be produced. This step can be accomplished by identifying the geographic region in which the diesel fuel blend shall be sold and setting the pre-determined flash-point and cetane number to ensure that the resulting diesel fuel blend conforms to the minimum legal requirements for such geographic region. Such minimum legal requirements are easily obtained in the public domain.

Step c) involves adding an amount of a first oxygenate with a flash-point less than the flash-point of said stock diesel fuel and a cetane number equal to or greater than the cetane number of said stock diesel fuel, said amount being sufficient to adjust the flash-point of the diesel fuel blend to the pre-determined flash-point. As described herein, numerous compositions of matter meet the definition of the first oxygenate and the first oxygenate to be used in the claimed method may be selected taking into account factors including the availability and cost of such first oxygenate. The first oxygenate is added using conventional apparatus and techniques employed in the art.

Step d) involves adding an amount of a second oxygenate with a flash-point equal to or greater than the flash-point of said stock diesel fuel and a cetane number greater than the cetane number of said stock diesel fuel, said amount being sufficient to achieve the pre-determined increase in cetane number. As described herein, numerous compositions of matter meet the definition of the second oxygenate and the second oxygenate to be used in the claimed method may be selected taking into account factors including the availability and cost of such second oxygenate. The second oxygenate is added using conventional apparatus and techniques employed in the art.

Oxygenates according to the present invention are defined as organic compounds that contain oxygen. While elements other than carbon, hydrogen and oxygen may be present in the oxygenates, such oxygenates typically do not contain sulfur or nitrogen because sulfur and nitrogen can be converted to SOx and NOx, respectively, under combustion conditions. However, oxygenates containing sulfur and/or nitrogen may be suitable for practicing this invention. The oxygenates are miscible with the stock diesel fuel over a wide temperature range and preferably decrease particulate matter and do not significantly affect the cloud point of the resulting diesel fuel blend. The first oxygenate can not be identical to the second oxygenate in order to achieve practice of the present invention. However, the term "identical" does not preclude use of distinct compositions represented by a chemical genus. For example, if the first oxygenate is monoglyme, an ether, the second oxygenate can be diglyme, also an ether, or any other suitable ether.

The first oxygenate must have a flash-point less than the flash-point of the stock diesel fuel and acts as a flash-point adjusting component. Moreover, the first oxygenate has a cetane number equal to or greater than the cetane number of the stock diesel fuel. The first oxygenate is added in order to adjust the flash point of the diesel fuel blend to the pre-determined flash-point.

The second oxygenate must have a flash-point equal to or greater than the stock diesel fuel. Moreover, the second oxygenate must have a cetane number greater than the cetane number of the stock diesel fuel. Since overall flash-point of the diesel fuel blend depends on the oxygenate having a lower flash-point, the presence of the other oxygenate will not substantially alter the flash-point established upon adding the first oxygenate.

The advantage of selecting oxygenates to control flash-point which also have high cetane numbers is to prevent the need to add additional components. The overall cetane number of a diesel fuel blend is a function of the cetane numbers of the chosen first and second oxygenates. In order to increase this cetane number the first oxygenate is required to have a cetane number at least equal to or greater than the stock diesel fuel, whereas the second oxygenate must have a cetane number greater then the stock diesel fuel.

More preferably, the first and/or the second oxygenate are selected from the group consisting of ethers, polyethers, acetals, long chain linear alcohols and esters of fatty acids.

In a particular preferred mode, the first oxygenate is selected from monoglyme, diethyl ether and diisopropyl ether and the second oxygenate is selected from diglyme, triglyme and dipentyl ether.

In an especially preferred embodiment, the first additive is monoglyme and the second additive is diglyme.

The amount of the first oxygenate to adjust the final flash-point can be obtained from a calibration curve established by measuring the final flash-point of respective mixtures of the stock diesel fuel and incremental amounts of the first oxygenate. Flash-points are measured according to standard procedures in the art disclosed in the textbook, Automotive Fuels Reference Book, 1995, Society of Automotive Engineers, Inc. (ISBN 1-56091-589-7).

To adjust the final flash-point, the amount of the first oxygenate can also be determined by the equation $$T_1/T_2=1+T_1R\ln[x]/\Delta H$$

This equation has been reported by G. J. Suppes et al. in Ind. Eng. Chem. Res. (1998, 37, p. 2029–2038). This reference does not address the problem solved by this invention.

In the equation, $T_2$ is the pre-determined flash point of the diesel fuel blend. $T_1$ is the flash-point temperature of the first oxygenate. R is the ideal gas constant (i.e. 8.314 J/mol/K), x is the mole fraction of the first oxygenate in the diesel fuel blend and ΔH is the enthalpy of vaporization of the first oxygenate. Handbooks containing physical properties of organic compounds can be consulted to obtain $T_1$ and ΔH. Table 1 shows physical properties of several oxygenates suitable for practicing the claimed invention.

TABLE 1

| Oxygenate | Cetane No. | Flash-pt. (° C.) | Δ $H_v$ (J/mol) | Mole. Wt | Density (g/ml) | PM Red % | Cloud Point |
|---|---|---|---|---|---|---|---|
| Diethyl ether | 160.158 | −40 | 29063 | 74 | 0.71 | | |
| Diisopropyl ether | 55–60 | −12 | 32540 | 102 | 0.73 | | |
| monoglyme | 105 | 0 | 32137 | 90 | 0.86 | 17.5 | <0 |
| Dipentyl ether | 130 | 63 | — | 158 | 0.78 | | |
| Diglyme | 282 | 64(1) | 46464 | 134 | 0.94 | 19.3 | <0 |
| 1-Nonanol | 46 | 75 | 57945 | 144 | 0.83 | | |
| 1-Dodecanol | 64 | >112 | 63457 | 186 | 0.83 | | |
| Diesel fuel | 45 | 61 | — | 225(2) | 0.83 | | <0 |

(1)average of two reported values, 57° C. and 70° C.
(2)assumed average molecular weight The particulate matter (PM Red. %) reduction and cloud point data presented in Table 1 are reported by Boehman et al., in American Chemical Society Division Petroleum Chemistry (1998) 43 (4), 593.

If experimental flash-point determinations are not readily at hand, then one skilled in the art can use equation 1 to calculate $T_2$.

The amount of the second oxygenate required to reach the predetermined increase in cetane number of the diesel fuel blend can be obtained from a calibration curve established by measuring the cetane number of respective mixtures of the stock diesel fuel and incremental amounts of the second oxygenate (i.e., mixtures formed by adding various volume percentages of second oxygenate the stock diesel fuel).

Figure 2:
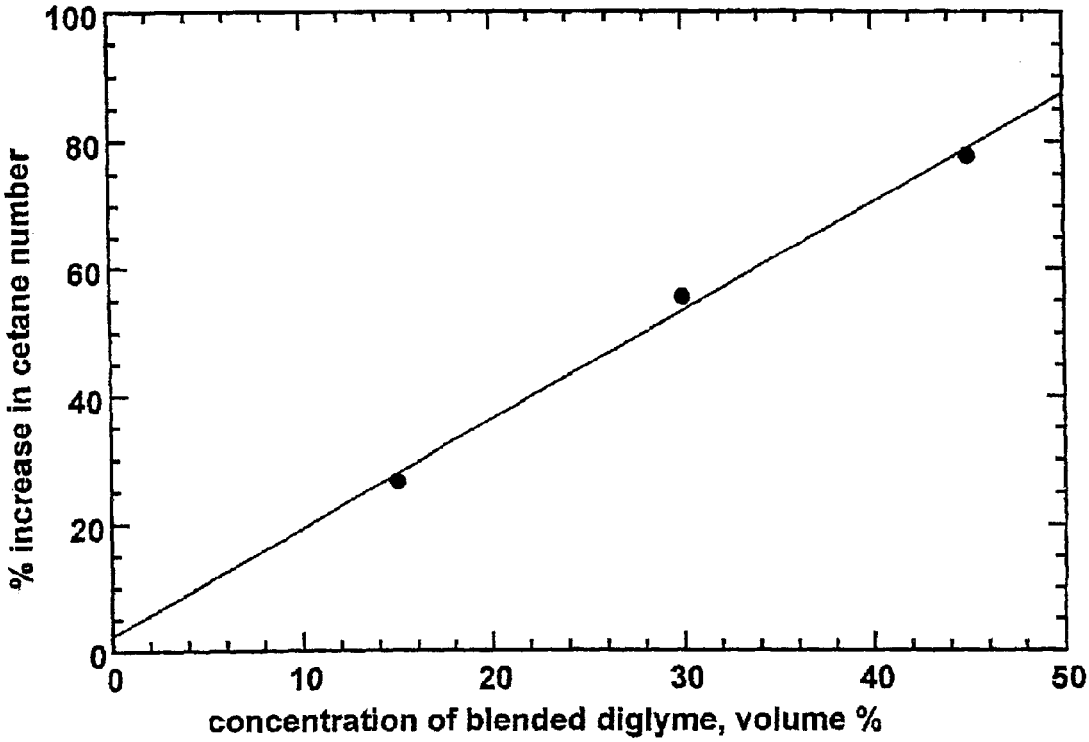
FIG. 2 illustrates the percentage increase in cetane number as a function of volume % of blended diglyme.
Figure 3:
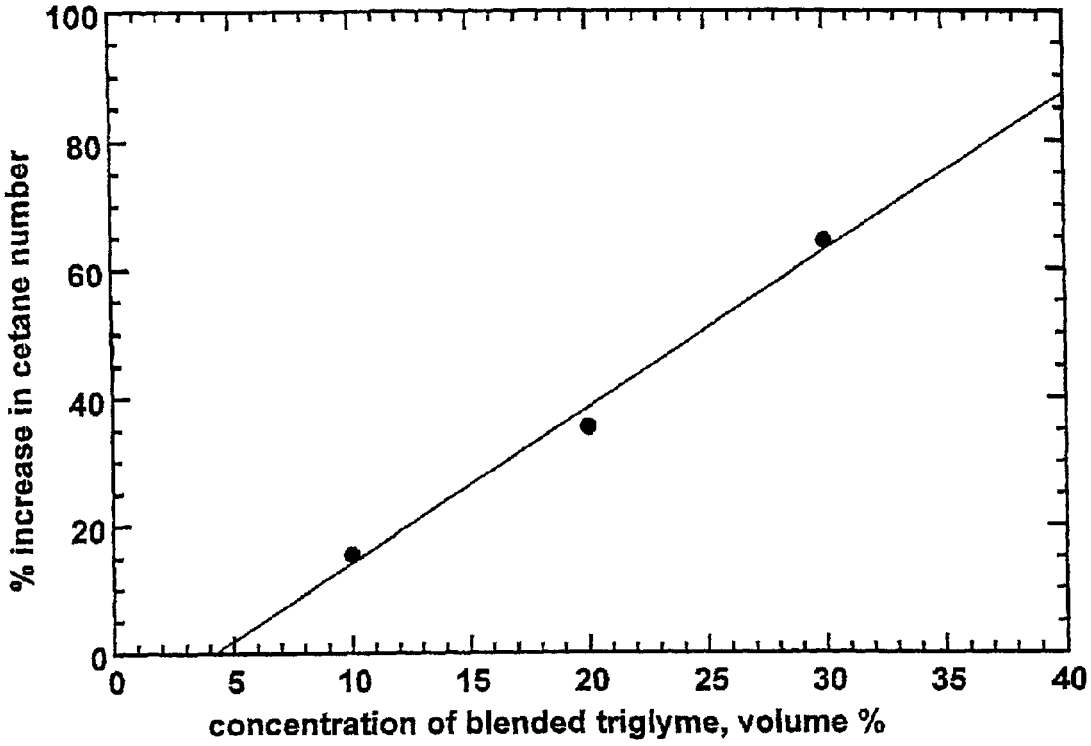
FIG. 3 shows a plot of the percentage increase in cetane number as a function of volume % of blended triglyme.

Because the second oxygenate has a cetane number greater than the stock diesel fuel the addition of the second oxygenate causes an increase in cetane number of the diesel fuel blend. This effect is illustrated in FIG. 2 and FIG. 3.

The method of the present invention will be further explained and understood by reference to the following examples. The characteristics of the stock diesel fuel used in the examples are presented in Table 1.

EXAMPLE 1

To illustrate dependency of flash-point on added vol. % of oxygenate, mixtures were prepared comprising the vol.-% of monoglyme, diglyme or a combination thereof indicated in Table 2, the balance being diesel fuel.

In Table 2 the experimental flash-point determination of these experiments are summarized. The flash-points for the mixtures of diglyme and diesel fuel remain close to the flash-point of the diesel fuel. This is because the flash-point of diglyme is near the flash-point of diesel fuel. However, when monoglyme is added to diesel fuel, the flash-points are very similar to the flash-points when monoglyme and diglyme are added to diesel fuel. This is because the flash-point of the three component mixture is determined by the flash-point of the most volatile component, monoglyme. The data in Table 2 is used to establish the plot of flash-point of diesel fuel mixed with oxygenates vs. volume-% blended monoglyme in FIG. 1.

TABLE 2

| Volume % Monoglyme | Volume % Diglyme | Volume % Diesel | Flash-Point (1) |
|---|---|---|---|
| 0 | 0 | 100 | 61 |
| 1 | 0 | 99 | 51 |

TABLE 2-continued

| Volume % Monoglyme | Volume % Diglyme | Volume % Diesel | Flash-Point (1) |
|---|---|---|---|
| 5 | 0 | 95 | 27 |
| 10 | 0 | 90 | 25 |
| 15 | 0 | 85 | 22 |
| 0 | 1 | 99 | 61 |
| 0 | 5 | 95 | 58 |
| 0 | 10 | 90 | 56 |
| 0 | 15 | 85 | 55 |
| 0 | 40 | 60 | 53 |
| 1 | 9 | 90 | 49 |
| 2 | 8 | 90 | 42 |
| 4 | 6 | 90 | 33 |
| 5 | 5 | 90 | 26 |
| 2 | 18 | 80 | 43 |
| 4 | 06 | 80 | 34 |
| 8 | 12 | 80 | 24 |
| 10 | 10 | 80 | 24 |

(1) closed cup method; temperature in ° C.

EXAMPLE 2

In Table 3 the flash-points of the stock diesel fuel containing varying diisopropyl ether content have been calculated using equation 1 and the appropriate values found in Table 3.

TABLE 3

| Compound | Volume % | Calculated flash-point of Diesel Fuel Blend (° C.) |
|---|---|---|
| Diisopropyl ether | 2.5 | 55 |
| Diisopropyl ether | 5.0 | 37 |
| Diisopropyl ether | 10.0 | 22 |

EXAMPLE 3

Diglyme increases the cetane number of the stock diesel fuel. This blending trend is shown in Table 4. The data in Table 4 is used to establish the plot in FIG. 2 of % increase of cetane number of the stock diesel fuel blended with the oxygenate versus volume % of blended diglyme.

TABLE 4

| Volume % Diglyme | Volume % Diesel | Cetane No. | % Inc. |
|---|---|---|---|
| 0 | 100 | 45 | — |
| 15 | 85 | 57 | 26.7 |
| 30 | 70 | 70 | 55.6 |
| 45 | 55 | 80 | 77.8 |
| 100 | 0 | 228 | — |

Presuming that the pre-determined flash-point of the diesel fuel blend is 37° C., and the skilled worker desires to use the two oxygenates, diisopropyl ether and diglyme, then volume percent of diisopropyl ether to be added is 5 volume-%. If the blended diesel fuel is to have an approximate 26% increase in cetane number, the blended diesel fuel must contain approximately 15 volume-% of diglyme. FIG. 2 or Table 4 is to be consulted for this data.

EXAMPLE 4

The same trend as in Table 4 is observed when triglyme is added to stock diesel fuel. The corresponding data are summarized in Table 5. The data in Table 5 are used to establish the percentage increase in cetane number of the stock diesel fuel blended with the oxygenate versus the volume % of blended triglyme, as shown in FIG. 3.

TABLE 5

| Volume % Triglyme | Volume % Diesel | Cetane Number | % Inc. |
|---|---|---|---|
| 0 | 100 | 45 | — |
| 10 | 90 | 52 | 15.6 |
| 20 | 80 | 61 | 35.6 |
| 30 | 70 | 74 | 64.4 |
| 100 | 0 | 119 | — |

EXAMPLE 5

In this example, the two selected oxygenates are diethyl ether and triglyme. Using equation 1 and the data in Table 1 for diethyl ether, flash-point of the mixture of the stock diesel fuel and the first oxygenate can be calculated. These calculated flash-points are presented in Table 6.

TABLE 6

| Compound | Volume % | Calculated Flash-Point of Diesel Fuel Blend (° C.) |
|---|---|---|
| diethyl ether | 0.5 | 55 |
| diethyl ether | 1.0 | 35 |
| diethyl ether | 2.5 | 13 |

If the predetermined flash-point is 38° C., and the predetermined increase in cetane number is approximately 16%, then 1 volume-% diethyl ether is used and approximately 10 volume-% of triglyme is used. FIG. 3 or Table 5 is to be consulted for this data. It must be remembered that the stock diesel fuel used in this example may be different than stock diesel fuels in other regions of the U.S., Canada or Europe. Specific calibration curves should be experimentally determined by measuring cetane number of known amounts of a given oxygenate, for example, triglyme, which are added to the available stock diesel fuel.

These examples demonstrate that the method of the present invention provides a diesel fuel blend which has both a pre-determined flash-point and a pre-determined increase in cetane number.

Furthermore it is demonstrated that according to the present invention, the flash-point and the cetane number can be controlled just by adding oxygenates which also improve the performance of the blended fuel in that selected oxygenates can decrease particulate matter emissions.

What is claimed is:

1. A method to produce a diesel fuel blend having a pre-determined flash-point and a pre-determined increase in cetane number, comprising the steps of:

a) selecting a stock diesel fuel with a flash-point and a cetane number, b) establishing the pre-determined flash-point and the pre-determined increase in cetane number of the diesel fuel blend to be produced;

C) adding an amount of a first oxygenate with a flash-point less than the flash-point of said stock diesel fuel and a cetane number equal to or greater than the cetane number of said stock diesel fuel, said amount being sufficient to adjust the flash-point of the diesel fuel blend to the pre-determined flash-point; and d) adding an amount of a second oxygenate with a flash-point equal to or greater than the flash-point of said stock diesel fuel and a cetane number greater than the cetane number of said stock diesel fuel, said amount being sufficient to achieve the pre-determined increase in cetane number wherein the first oxygenate and the second oxygenate are not the same oxygenate.

2. The method of claim 1 wherein the first oxygenate is selected from the group consisting of ethers, polyethers, acetals, long chain linear alcohols and esters of fatty acids.

3. The method of claim 1 wherein the second oxygenate is selected from the group consisting of ethers, polyethers, acetals, long chain linear alcohols and esters of fatty acids.

4. The method of claim 1 wherein the first oxygenate is selected from monoglyme, diethylether and diisopropylether.

5. The method of claim 1 wherein the second oxygenate is selected from diglyme, triglyme and dipentylether.

6. The method of claim 1 wherein the said first additive is monoglyme and said second additive is diglyme.

7. The method according to claim 1 wherein the amount of the first oxygenate to adjust the flash point of the stock diesel fuel to the pre-determined flash-point of the diesel fuel blend is determined by the equation $$T_1/T_2=1+T_1 R ln[x]/\Delta H$$

wherein $T_1$ is the flash-point temperature of the first oxygenate, $T_2$ is the pre-determined flash-point temperature of the diesel fuel blend, R is the ideal gas constant, $\Delta H$ is the enthalpy of vaporization of the first oxygenate and

[x] is the mole fraction of the first oxygenate in the diesel fuel blend.

8. The method of claim 1 wherein the amount of the first oxygenate to be added is obtained from a calibration curve established by measuring the flash-point of mixtures of the stock diesel fuel and the first oxygenate.

9. The method of claim 1 wherein the amount of the second oxygenate to be added is obtained from a calibration curve established by measuring the cetane number of mixtures of the stock diesel fuel and the second oxygenate.

* * * * *